US006969457B2

(12) United States Patent
MacDonald et al.

(10) Patent No.: US 6,969,457 B2
(45) Date of Patent: Nov. 29, 2005

(54) METHOD FOR PARTIALLY STRIPPING A COATING FROM THE SURFACE OF A SUBSTRATE, AND RELATED ARTICLES AND COMPOSITIONS

(75) Inventors: Leo Spitz MacDonald, Schenectady, NY (US); Bin Wei, Mechanicville, NY (US); Michel Joseph Shaw, Albuquerque, NM (US); John Robert LaGraff, Niskayuna, NY (US); Warren Davis Grossklaus, West Chester, OH (US); Stephen Joseph Ferrigno, Cincinnati, OH (US); Tris Colaizzi, Marita Chiba (JP)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/273,727

(22) Filed: Oct. 21, 2002

(65) Prior Publication Data

US 2004/0074783 A1 Apr. 22, 2004

(51) Int. Cl.[7] ..... C25F 5/00
(52) U.S. Cl. ..... 205/674; 205/115; 205/717
(58) Field of Search ..... 205/640, 674, 205/675, 115, 717

(56) References Cited

U.S. PATENT DOCUMENTS

| | | | | |
|---|---|---|---|---|
| 3,779,879 A | | 12/1973 | Scott | |
| 3,788,958 A | | 1/1974 | Dillenberg | |
| 4,128,463 A | | 12/1978 | Formanik | |
| 4,142,954 A | | 3/1979 | Lucas | |
| 4,246,083 A | | 1/1981 | Notton | |
| 4,324,626 A | | 4/1982 | McGivern, Jr. | |
| 4,400,248 A | | 8/1983 | Tomaszewski | |
| 4,678,552 A | | 7/1987 | Chen | |
| 4,851,093 A | | 7/1989 | Routsis | |
| 4,894,130 A | | 1/1990 | Sova | |
| 5,327,134 A | | 7/1994 | Nakamura et al. | |
| 5,976,265 A | | 11/1999 | Sangeeta et al. | |
| 6,042,880 A | | 3/2000 | Rigney et al. | |
| 6,165,345 A | * | 12/2000 | Updegrove et al. | 205/717 |
| 6,174,448 B1 | | 1/2001 | Das et al. | |
| 6,352,636 B1 | | 3/2002 | Wei et al. | |
| 2003/0173213 A1 | * | 9/2003 | Lee et al. | 204/290.01 |

FOREIGN PATENT DOCUMENTS

| | | |
|---|---|---|
| EP | 318886 B1 | 7/1992 |
| EP | 989210 A1 | 3/2000 |
| EP | 1010782 | 6/2000 |
| WO | 9941435 | 8/1999 |
| WO | 42242 | 7/2000 |

* cited by examiner

*Primary Examiner*—Roy King
*Assistant Examiner*—Harry D. Wilkins, III
(74) *Attorney, Agent, or Firm*—Paul J. DiConza; William E. Powell, III

(57) ABSTRACT

An electrochemical process for selectively stripping at least one coating from the surface of a substrate is disclosed. The substrate (often a turbine engine component) is immersed in a composition through which electrical current flows. The composition includes a halide salt, such as sodium chloride, ammonium chloride, and potassium chloride. In preferred embodiments, the electrical current is direct current (DC). The process is especially useful for selectively removing portions of diffusion aluminide coatings. For example, the additive layer can efficiently be removed, without substantially affecting the underlying diffusion layer or substrate. Related stripping compositions and apparatuses are also described.

29 Claims, 6 Drawing Sheets

METHOD FOR PARTIALLY STRIPPING A COATING FROM THE SURFACE OF A SUBSTRATE, AND RELATED ARTICLES AND COMPOSITIONS

TECHNICAL FIELD

The present invention is generally concerned with electrochemical methods for removing coating material from a substrate. More specifically, the invention relates to a method for removing a portion of a coating from a substrate, while preserving the remaining portion of the coating.

BACKGROUND OF THE INVENTION

Metal structures used in high-performance equipment are often subjected to rigorous operating conditions. For example, various turbine engine components are exposed to significant temperature extremes and degradation by oxidizing and corrosive conditions. Thus, it is common practice in the industry to protect such parts with specialized coatings, such as diffusion coatings and overlay coatings. These coatings are sometimes used in combination with ceramic coatings, e.g., those based on yttria-stabilized zirconia.

In particular, diffusion aluminide coatings are very frequently used to enhance the environmental resistance of the turbine engine components. They are generally formed of aluminide-type alloys, such as nickel-aluminide, platinum-aluminide, or nickel-platinum-aluminide. The coatings are well-known in the art, as exemplified by U.S. Pat. No. 6,042,880 (Rigney et al). They can be applied by a variety of processes, such as pack cementation, above-the-pack deposition, vapor phase deposition, chemical vapor deposition (CVD), and slurry coating processes. Diffusion aluminide coatings typically include two regions or "sublayers": an additive sublayer which lies on top of the base metal, and a diffusion sublayer below the additive sublayer, which is incorporated into the upper region of the base metal.

In view of the high temperature and harsh operating conditions to which they are sometimes exposed, diffusion aluminide coatings eventually need to be repaired or replaced. Various coating repair methods are sometimes used. For example, the coating can be rejuvenated by certain techniques. As an illustration, the coating surface can be cleaned, and additional coating material can then be applied over the existing coating by one of the deposition processes listed above. Such a technique is advantageous because it tends to maintain the wall thickness of the component. However, after rejuvenation is complete, the coating is sometimes thicker than allowed by dimensional specifications.

Diffusion coating removal and replacement can be required under different circumstances. For example, rejuvenation of a worn or damaged coating may not be possible or beneficial in some instances. Moreover, a coating may have to be removed to permit inspection and possible repair of the underlying substrate.

Coating removal is typically carried out by immersing the component in a stripping solution. A variety of stripping techniques are currently available for removing different types of coatings from metal substrates. The techniques usually must exhibit a considerable amount of selectivity. In other words, they must remove only intended materials, while generally preserving the article's desired structures.

Chemical etching is a popular stripping technique. In such a process, the article is submerged in an aqueous chemical etchant, e.g., one based on one or more strong mineral acids like hydrochloric acid, sulfuric acid, and the like. The metallic coating on the article surface is dissolved as a result of reaction with the etchant.

While chemical etching is effective for a number of situations, it has certain drawbacks. For example, it is often a relatively nonselective process. Thus, in the case of diffusion aluminide coatings, chemical etching tends to remove both the additive sublayer and the underlying diffusion sublayer. Repeated stripping and reapplications of these coatings necessitate repeated removal of the diffusion sublayer. This can undesirably decrease the thickness of the substrate, e.g., a turbine airfoil. Moreover, chemical etching can result in the stripping of coatings from internal passages in the article, which is often undesirable.

Electrochemical stripping processes overcome some of the disadvantages inherent in conventional techniques such as chemical etching. For example, U.S. Pat. No. 6,352,636 describes a very useful electrochemical stripping process. In general, the process selectively removes metallic coatings from the external sections of a metallic article, such as a turbine component.

Nevertheless, additional stripping processes would be welcome in the art. They should be capable of removing substantially all of a given coating, or a selected region of the coating, while not substantially attacking an underlying coating, or a base metal. They should also preserve the structural and dimensional integrity of the base metal, as well as internal passages and cooling holes which may be located within an article of the base metal (e.g., a turbine component).

The stripping processes should not result in the formation of an unacceptable amount of hazardous fumes in the workplace, or produce effluent which cannot easily be treated. Moreover, the new processes should include enhanced process windows, e.g., the time period between the desired removal of selected coating layers and the occurrence of significant damage to other layers or to the substrate. These process windows would provide flexibility and efficiency in a large-scale treatment facility.

SUMMARY OF THE INVENTION

One embodiment of this invention is directed to an electrochemical process for selectively removing (i.e., "stripping") at least one coating from the surface of a substrate. The substrate—often a turbine engine component—is immersed in a composition through which electrical current flows. The composition comprises at least one halide salt, such as sodium chloride, ammonium chloride, and potassium chloride. In preferred embodiments, the electrical current is direct current (DC).

The process is especially useful for selectively removing portions of diffusion aluminide coatings. As discussed above, these coating systems, such as nickel aluminide and platinum-aluminide, usually include an additive layer and an underlying diffusion layer (both referred to as "sublayers" below). The process permits efficient removal of the additive sublayer, without substantial removal of the diffusion sublayer, and without substantial damage to the substrate.

Another embodiment relates to a process for replacing a worn or damaged diffusion aluminide coating applied over a substrate. The process briefly described above is first used to efficiently strip the substrate of the worn coating. A new coating (e.g., of the same type, or of a different type) is then applied over the substrate, as explained below.

Still another embodiment is directed to an electrochemical stripping composition for selectively removing a diffusion aluminide coating from a substrate. The composition comprises at least one halide salt, as described below. The salt is present in the composition at a concentration in the range of about 0.1 M to about 5 M.

An additional embodiment exists in the form of an apparatus. The apparatus is used in the electrochemical removal of coatings from various substrates, e.g., superalloy articles. The apparatus is described and illustrated later in the specification. In brief, it comprises:

(a) an electrolyte which comprises at least one halide salt;

(b) a direct current (DC) source, capable of being connected to the coated substrate and an electrode; and (c) at least one electrode from which the current source can apply electrical current through the electrolyte to the coated substrate.

DETAILED DESCRIPTION OF THE INVENTION

The process of this invention can be used to treat many different types of substrates. They are usually metallic. Non-limiting examples of metallic materials are those which comprise at least one element selected from the group consisting of iron, cobalt, nickel, aluminum, chromium, titanium, and mixtures which include any of the foregoing (e.g., stainless steel). Very often, the metallic material is a superalloy. Such materials are typically nickel-, cobalt-, or iron-based. Illustrative nickel-base superalloys include at least about 40 wt % Ni, and at least one component from the group consisting of cobalt, chromium, aluminum, tungsten, molybdenum, titanium, and iron. Illustrative cobalt-base superalloys include at least about 30 wt % Co, and at least one component from the group consisting of nickel, chromium, aluminum, tungsten, molybdenum, titanium, and iron.

Figure 1:
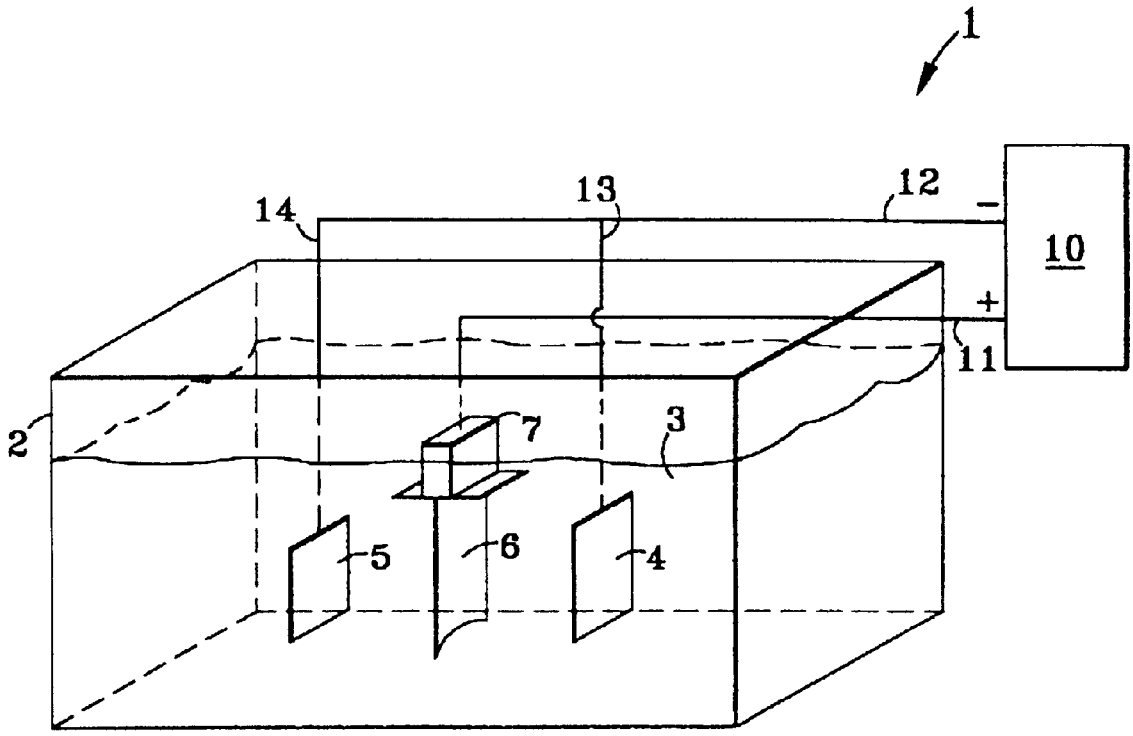
FIG. 1 is a schematic illustration of an electrochemical stripping system.

Various electrochemical stripping systems may be used for the present invention. One suitable apparatus is described in U.S. Pat. No. 6,352,636, assigned to the assignee of the present invention, and incorporated herein by reference. FIG. 1 schematically illustrates such a system 1, which includes an electrolyte bath receptacle 2. The bath contains electrolyte 3, and may also contain other additives which are described below.

The electrolyte for the present invention comprises at least one halide salt. Non-limiting examples of the halide salts include sodium chloride, ammonium chloride, potassium chloride, sodium bromide, sodium fluoride, ammonium bifluoride, and various combinations thereof. Sodium chloride or potassium chloride, or a mixture thereof, is often preferred. Sodium chloride is especially preferred for many embodiments. Precursors of the salt may also be employed. As used herein, a "precursor" refers to any compound or group of compounds which can be combined to form one or more of the halide salts mentioned above. Thus, the salt can be formed in-situ in a reaction vessel, for example.

The halide salt is usually present in the composition at a level in the range of about 0.1 M to about 5 M. In more preferred embodiments, the level of the salt is often in the range of about 0.5 M to about 3.5 M. Adjustment of the amount of the salt can readily be made by considering stoichiometric parameters, and by observing the effect of particular compositions on the removal of a desired coating from the substrate.

The stripping composition may include various other additives which serve a variety of functions. Non-limiting examples include inhibitors, dispersants, surfactants, wetting agents, stabilizers, anti-settling agents, and pH buffers. Those of ordinary skill in the art are familiar with specific types of such additives, and with effective levels for their use.

The electrolyte bath receptacle 2 (sometimes referred to herein as the "receptacle") is formed of any suitable material which is non-reactive with any of the bath components. The shape and capacity of the receptacle 2 may vary according to the application, as long as the receptacle is sized sufficiently to accommodate the electrodes, the electrolyte 3, and the coated article being stripped. The electrochemical stripping system of this invention includes at least one electrode. Two electrodes are depicted in FIG. 1. The number of electrodes will vary, depending on various factors, such as the size and shape of the article being treated.

Each electrode, 4 and 5, is formed with an appropriate geometry that is configured to direct electrical fields to the surfaces of the coated article 6. As described in U.S. Pat. No. 6,352,636, appropriate geometric configurations for the electrodes include, but are not limited to, planar geometries, cylindrical geometries, and combinations thereof. Each electrode can have a complex, geometric shape, e.g., one that is approximately complementary to the geometry of the article 6 that is to be stripped (see FIG. 2, for example). The electrodes 4 and 5 (FIG. 1) are generally non-consumable, and remain intact throughout the electrochemical stripping process.

The article 6, which is to be stripped by the electrochemical stripping system 1, is disposed in the receptacle 2. The article is at least partially covered with one or more of the coatings described previously. The article 6 is disposed between the electrodes 4 and 5, and positioned so that an electric field can be established between the electrodes and the selected coated surfaces of the article. The electrolyte 3 is delivered to the receptacle 2 in amounts sufficient to submerge parts of the article 6 and electrodes 4 and 5. If a portion 7 of the article, e.g., a dovetail section of a turbine component, does not require stripping, this portion may be kept above the level of the electrolyte 2. Alternatively, this portion 7 can be physically masked so as to shield the electric field. A further alternative is to minimize the electric field over this portion of the component surface, for example, by modifying the electrode location. The portions of the article 6 that are to be electrochemically stripped should be submerged in the electrolyte 3.

Figure 4:
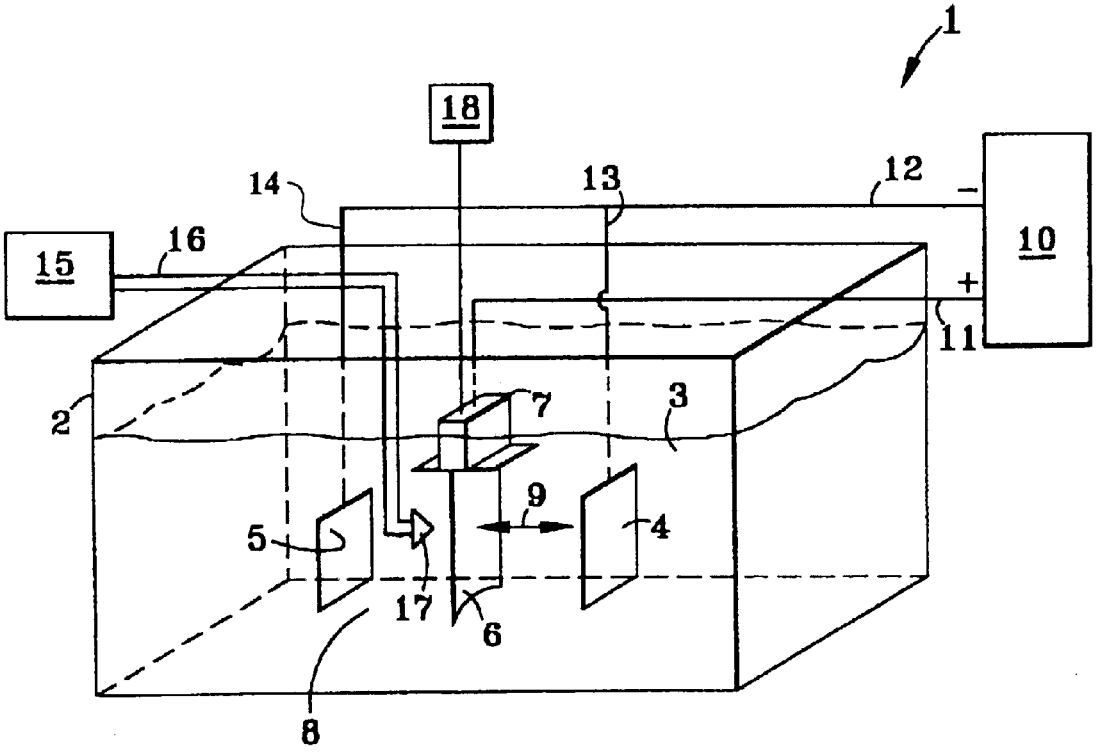
FIG. 4 is a schematic illustration of another electrochemical stripping system.

The electrolyte 3 can be delivered into the receptacle 2 by any appropriate means. For example, and in no way limiting of the invention, the electrolyte may be poured into the receptacle 2. Alternatively, the electrolyte 3 can be delivered into the receptacle 2 by a pumping device, as shown in FIG. 4. In this figure, the pumping device 15 is connected to the receptacle 2 via a conduit 16. The conduit 16 extends to a gap 8 that is disposed between the article 6 and one of the electrodes 4 or 5. The pumping device 15 can comprise a low-pressure pump, which agitates and stirs electrolyte 3 in the receptacle 2. For example, ejection of the electrolyte 3 from a nozzle 17 of the pumping device 15 can cause agitation and stirring of the electrolyte 3 in the receptacle 2.

Alternatively, the article 6 can be moved, reciprocally or rotated about its own or a displaced axis, by an appropriate support 11, as illustrated by arrow 9 (FIG. 4). The article 6 can be moved by an appropriate motive device 18 in the electrolyte 3, such as but not limited to, at least one of mechanical and magnetic devices. The movement of the electrolyte 3 accelerates Joule heat dissipation and helps maintain a homogeneous electrolyte composition during the electrochemical stripping process. Excessive heat or local changes in electrolyte chemistry may alter the stripping reaction. For example, the reaction rate may be decreased, or there may be an increase in the degree of parent-alloy attack.

A power supply 10 establishes an electric field in the electrochemical stripping system 1 (see FIG. 1). The power supply is direct current (DC). It is often operated in the constant potential mode. The present inventors discovered that, when using the claimed electrolyte, continuous, direct current provides better stripping characteristics, as compared to results obtained using the pulse mode.

With reference to FIG. 1, power supply 10 carries current over connections 12, 13, and 14, to the electrodes 4 and 5. The electrodes, 4 and 5, are connected to the negative terminals of the power supply 10. The stripping of the coating from article 6 comprises the electrolyte reacting with the coating. The electrolyte carries charge to article 6, and under the action of the electric current, the coating is stripped from the article. Removal of the current halts the electrochemical stripping process.

Various parameters define the stripping characteristics for the present invention. These parameters influence the rate of material removal and thus, the efficiency of the stripping process. Non-limiting, exemplary parameters are: electrode geometry, power supply voltage or current (dependent on parameters being controlled); electrolyte concentrations, solvent composition, use of (and degree of) agitation, processing time, distance between the article and electrodes, and electrolyte temperature. Those who are familiar with electrochemical machining techniques would be familiar with many of the stripping parameters which relate to the present invention.

The stripping parameters may vary over operational ranges. For example, a DC power supply voltage may vary from a trace voltage (the term "trace" means a small but measurable value, e.g., 0.1V) to about 10V. The distance between the article 6 and an electrode typically varies in a range from about 0.1 inch (0.25 cm) to about 10 inches (25.4 cm).

The most appropriate range of voltage (cell potential) for partial stripping will depend on many of the factors described previously. As an illustration in the case of a diffusion aluminide-type coating, the voltage should be high enough to remove the additive sublayer, but low enough to avoid significant removal of the diffusion sublayer. Frequently, the selected voltage is in the range of about 0.5 volt to about 5 volts, based on an article-electrode distance of about 5 inches (13 cm). (When the distance or "gap" is greater, higher voltage is used). In general, the distance (like the other parameters described herein) can be readily adjusted by those skilled in the art, based on empirical results for different stripping conditions.

The stripping composition is effective over a wide range of pH values. As an example, the pH usually ranges from about 1 to about 8. In some preferred embodiments, the composition is maintained at a pH of less than about 5, which sometimes results in a smoother surface after treatment is complete.

As alluded to previously, an important feature of this invention is the relatively high degree of selectivity it can provide. In other words, the time required to remove a desired coating is much less than the time which elapses before the undesirable removal of an underlying coating or a substrate material. In preferred embodiments, the selectivity (ratio of coating removal to substrate material or underlying material) is greater than about 4:1, and preferably, greater than about 6:1. The enhanced selectivity is especially (but not exclusively) useful in the case of the diffusion aluminide coatings, as described in the examples.

The temperature of the electrolyte in solution can be maintained up to about 100° C. In preferred embodiments, the temperature is maintained below about 50° C. In some especially preferred embodiments, the temperature range is from about 5° C. to about 30° C. Lower temperatures within these ranges are sometimes preferred for minimizing chemical reaction on any internal surfaces of the part being treated. The lower temperatures are also sometimes preferred when the stripping composition is being operated at a relatively low pH, as discussed above.

The stripping time (i.e., the immersion time within the aqueous composition, during the application of electrical power) may vary considerably. Factors which influence the selection of an appropriate time include the composition of the coating being removed; as well as its microstructure, density, and thickness. (Diffusion aluminide coatings usually have a thickness of about 5 microns to about 125 microns). The electrochemical stripping time may increase with higher density and thicker coatings. Usually, the time will range from about 1 minute to about 36 hours, and preferably, from about 5 minutes to about 8 hours. In some instances, an especially preferred immersion time is in the range of about 10 minutes to about 3 hours. As those skilled in the art are aware, the stripping time can also be monitored by electrical current characteristics in the aqueous composition.

Figure 2:
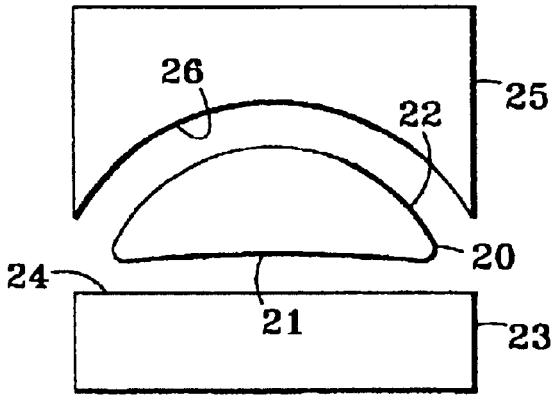
FIG. 2 is a schematic illustration of an exemplary geometrical configuration for a cathode and anode arrangement in an electrochemical stripping system.

FIG. 2 (mentioned previously) and FIG. 3 illustrate two exemplary geometries for the electrodes, as embodied by this invention. These electrode geometries are applicable to stripping a metallic coating from various articles, such as turbine components. However, they are merely exemplary of the geometries within the scope of the invention, and are not meant to limit the invention in any manner.

With the electrode geometry of FIG. 2, an article 20 comprises a configuration with a generally straight side 21 and a convex side 22 (a common shape for some of the components of a gas turbine engine). An electrode 23 comprises a side 24, which faces'side 21. Similarly, an electrode 25 has a side 26 that is generally complementary to the side 22 of the article, e.g. the turbine component. Thus, in some preferred embodiments, the electrodes 23 and 25 at least partially surround the article.

Each electrode 23 and 25 can be connected to one terminal of the power supply. The article 20 is connected to the other terminal. When current is passed between the electrodes 23 and 25 and the article 20, the surfaces of the article will be electrochemically stripped, as embodied by the invention.

Figure 3:
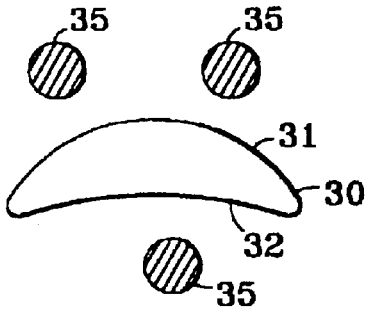
FIG. 3 is a schematic illustration of another exemplary geometrical configuration for a cathode and anode arrangement in an electrochemical stripping system.

The electrode configuration of FIG. 3 comprises an article 30 and a plurality of electrodes 35. Alternatively, multiple components to be stripped can be presented in the stripping system, as embodied by the invention. Article 30 is in the shape of a turbine component, as an example. The article includes a convex surface 31 and a concave surface 32. The electrodes 35 are disposed around the article to provide an approximately uniform electrical field. Each electrode 35 is connected (not shown) to one terminal of the power supply, while the article 30 is connected to the other terminal. When current (at a selected cell potential) is passed between the electrodes 35 and the article 30, the surfaces of the article will be electrochemically stripped.

Figure 5:
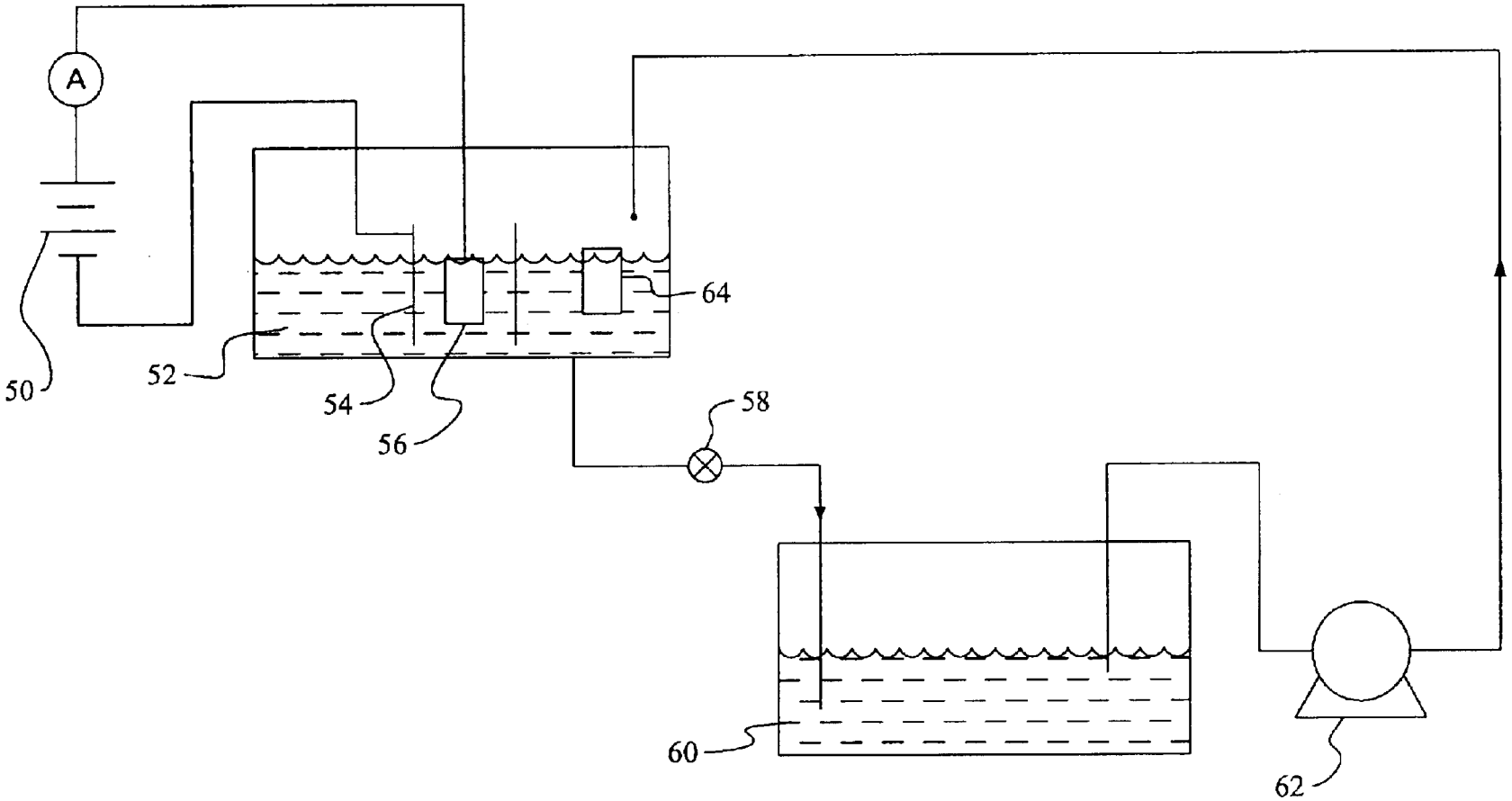
FIG. 5 is a schematic illustration of another electrochemical stripping system suitable for the present invention.

FIG. 5 is a schematic illustration of another electrochemical stripping system which may be used for the present invention. The stripping system includes power supply 50, which is usually direct current (DC). Reaction tank 52 holds the electrolyte and the electrodes. Cathode 54 may contain perforations. For example, it may be in the form of a screen, to allow for enhanced solution flow. Alternatively, the cathode can be a solid conductor which may or may not conform to the surface of coated article 56, which is being treated. Control valve 58 continuously drains the tank at a constant rate. Sump tank 60 stores the electrolyte-solution, while pump 62 replenishes the electrolyte to the tank. Level sensor 64 turns the pump on and off, to maintain a consistent level of electrolyte in the reaction tank.

The electrochemical stripping system of FIG. 5 contains features which are very advantageous for some embodiments of the invention. For example, relatively slow, controlled fluid motion occurs in reaction tank 52, as the electrolyte drains from the tank through control valve 58. This fluid motion provides a slight amount of agitation which is helpful in forcing an exchange of reactants and products at the anode and cathode boundary layers. (However, excessive agitation is usually undesirable). Moreover, this type of fluid-recirculating assembly ensures substantial homogeneity of the electrolyte in the reacting tank. The recirculating system also removes precipitates from the reaction tank to the sump tank, from which they can be filtered out of the system.

Figure 6:
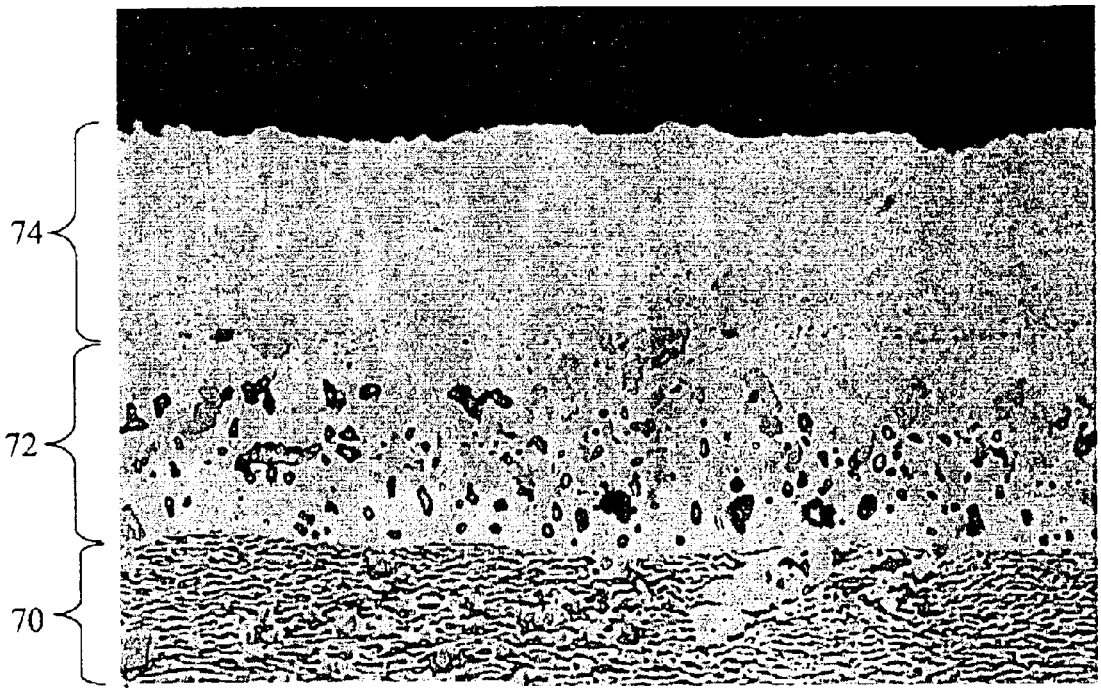
FIG. 6 is a cross-sectional photomicrograph of a platinum aluminide diffusion coating applied over a metal substrate.

As mentioned previously, the present invention is especially useful in a partial stripping operation, e.g., removing individual coating sublayers of aluminum based diffusion coatings. Diffusion coatings are typically formed of aluminide-type materials, which are well-known in the art. Such materials are sometimes modified with a noble metal, such as platinum or palladium. Non-limiting examples include aluminide, platinum-aluminide, nickel-aluminide, platinum-nickel-aluminide, and mixtures thereof. FIG. 6 is a photomicrograph of a platinum aluminide diffusion coating applied over a superalloy substrate. In this figure, region 70 is the substrate, while region 72 generally represents the diffusion sublayer of a platinum aluminide diffusion coating. Region 74 is the additive sublayer of the diffusion coating. In applying diffusion coatings to a substrate, the additive sublayer causes the substrate (e.g., a turbine wall) to gain thickness. The diffusion sublayer consumes a certain thickness of the wall material.

Conventional, "full-stripping" processes usually remove both additive sublayer 74 and diffusion sublayer 72. However, the present invention is a "partial stripping" process, in which only additive sublayer 74 is removed. Such a process, which does not substantially affect the diffusion sublayer, is especially advantageous in some situations. The wall section of certain turbine engine airfoils provides one illustration, as mentioned previously. Removal of significant portions of such a wall is sometimes unacceptable, in view of the required thickness specifications. Thus, the partial-stripping embodiment of this invention is extremely useful for those instances in which the wall thickness must be preserved during the stripping process.

As the example below demonstrates, use of the halide salts in the electrochemical stripping process, under controlled conditions, successfully removes the additive sublayer, while leaving the diffusion sublayer substantially unaffected. The substrate (i.e., the base metal) is also substantially unaffected. Moreover, the process provides an extended period of treatment-exposure time between removal of the additive sublayer and removal of (or damage to) the diffusion sublayer. The extended time period is an important feature for processing-flexibility on a commercial scale.

Treatment of the article in the stripping bath according to this invention severely degrades the integrity of the coating being removed. The degraded coating is referred to herein as "smut" or "coating residue". The coating residue (e.g., of a full coating or of an uppermost sublayer of a coating) often continues to weakly adhere to the underlying substrate (or sublayer). Consequently, the treatment is usually followed by a post-stripping step, often referred to as a "de-smutting" operation. (Those familiar with the art understand that, as used in this specification, the term "removal" of the desired coating means severe degradation of the coating, so that it can then be cleaned from the substrate with this routine desmutting technique).

The desmutting step is known in the art, and described in various references. It may be in the form of an abrasion step which minimizes damage to the substrate or the underlying sublayer. As one example, grit-blasting can be carried out by directing a pressurized air stream containing aluminum oxide particles across the surface. The air pressure is usually less than about 100 psi. The grit-blasting is carried out for a time period sufficient to remove the degraded coating. The duration of grit-blasting in this embodiment will depend on various factors, such as the thickness and specific composition of the smut layer; the size and type of grit media, and the like. The process is typically carried out for about 30 seconds to about 3 minutes. Low-pressure grit-blasting (e.g., at about 30 psi or less, and sometimes called "grit-dusting") is sometimes preferred.

Other known techniques for abrading the surface may be used in lieu of grit-blasting. Many of these are described in U.S. Pat. No. 5,976,265, incorporated herein by reference. For example, the surface can be manually scrubbed with a fiber pad, e.g. a pad with polymeric, metallic, or ceramic fibers. Alternatively, the surface can be polished with a flexible wheel or belt in which alumina or silicon carbide particles have been embedded. Liquid abrasive materials may alternatively be used on the wheels or belts. These alternative techniques would be controlled in a manner that maintained a contact force against the surface that was no greater than the force used in the grit-blasting technique discussed above.

Other techniques (or combinations of techniques) could be employed in place of abrasion, to remove the degraded material. Examples include water-jet cleaning; tumbling of the article (e.g., water-tumbling, with or without abrasive beads), or laser ablation of its surface. Alternatively, the degraded material could be scraped off the surface. As still another alternative, sound waves (e.g., ultrasonic) could be directed against the surface, causing vibrations which can shake loose the degraded material. For each of these alternative techniques, those skilled in the art would be familiar with operating adjustments which are made to control the relevant force applied against the surface of the article (as in the case of the abrasion technique), to minimize damage to the substrate or coating sublayer being preserved. The article is sometimes rinsed after this step, e.g., using water or a combination of water and a wetting agent.

As mentioned previously, another embodiment of this invention relates to a method for replacing a worn or damaged protective coating applied over the substrate. As used herein, "worn" is meant to describe a coating which no longer offers a desired level of oxidation protection. The first step of this embodiment is the electrochemical removal of the coating by the process described above. In other words, the substrate is immersed in an aqueous composition through which electrical current flows, wherein the aqueous composition comprises at least one halide salt. The electrochemical treatment is usually followed by de-smutting and rinsing steps, as discussed previously.

The replacement coating can then be applied to the substrate. Examples of coatings to be applied include the diffusion-aluminide coatings, and overlay coatings. A non-limiting example of an overlay coating is one having a composition of the formula MCrAl(X), where M is an element selected from the group consisting of Ni, Co, Fe, and combinations thereof; and X is an element selected from the group consisting of Y, Ta, Si, Hf, Ti, Zr, B, C, and combinations thereof. The overlay coatings are applied to the surface by conventional techniques, such as high velocity oxy-fuel (HVOF), plasma spray (e.g., air plasma spray), physical vapor deposition, and the like. (Diffusion aluminide coatings can be applied as described previously). Those skilled in the art are aware of other aspects of the coating process, e.g., cleaning and/or surface roughening steps, when appropriate.

This replacement process is especially useful in the case of diffusion aluminide coatings. As described previously, repeated stripping and re-applications of such coatings can undesirably decrease the thickness of the substrate, e.g., a turbine airfoil. However, when a partial stripping process is carried out according to this invention, the additive sublayer of such a coating can be repeatedly removed and replaced, without substantially affecting the underlying diffusion sublayer. Thus, the specified wall thickness of the airfoil can be maintained for a greater service period. This advantage is an important feature in a commercial setting, where component replacement or repair can be a time-consuming and expensive undertaking.

The following example is merely illustrative, and should not be construed to be any sort of limitation on the scope of the claimed invention. In each instance of coating removal, the stripping step was followed by a de-smutting step, as described above. Usually, de-smutting consisted of grit-blasting, followed by air-blowing of the surface.

EXAMPLE 1

A coupon formed from a nickel-base superalloy was used in this example. A platinum layer having a thickness of about 1–2 microns was electroplated onto the superalloy surface. The coated surface was then diffusion-aluminided to a depth of about 50 microns. The coated coupon was subsequently treated according to an embodiment of this invention, to determine the effect of the treatment over a pre-selected time period.

Treatment of the coupon was carried out by using an electrochemical stripping system similar to that depicted in FIG. 1. The distance from the cathode to the anode in the stripping apparatus was about 1 inch (2.54 cm). 10% NaCl (by weight) in water was used as the electrolyte. The stripping bath was maintained at room temperature. A voltage (cell potential) of about 1.2 volts DC (direct current) was applied to the electrochemical cell.

Figure 7:
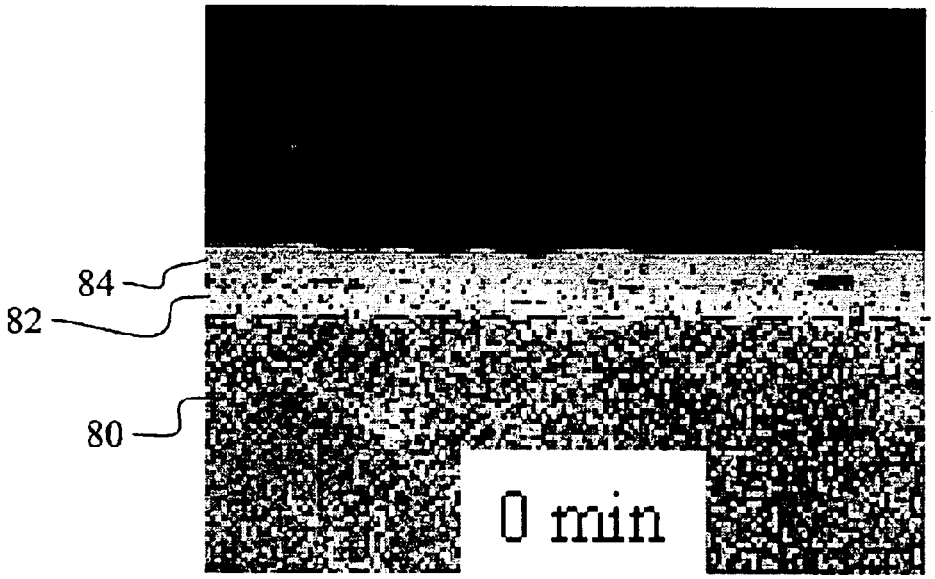
FIGS. 7–10 represent a time series of cross-sectional photomicrographs of a coating system similar to that of FIG. 6, after being treated by the present invention's partial stripping process.
Figure 8:
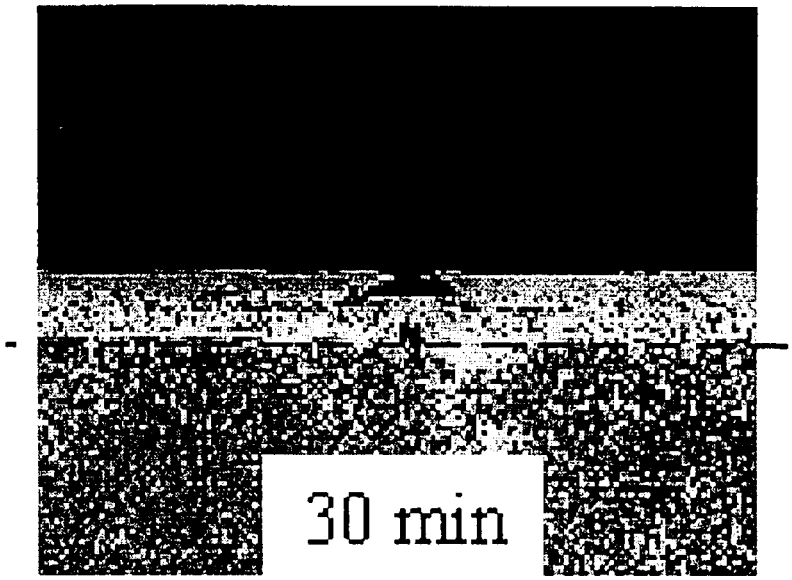
Figure 9:
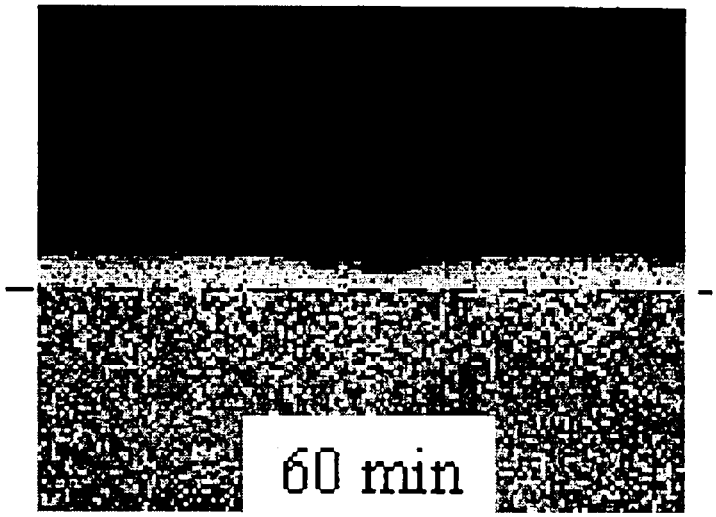
Figure 10:
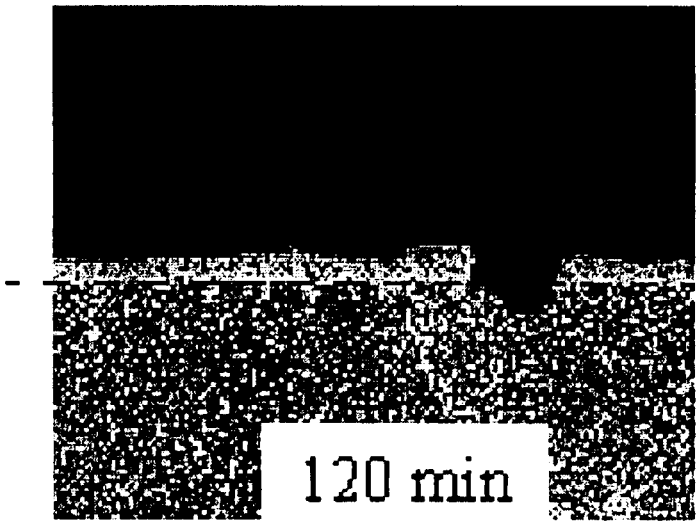

FIGS. 7, 8, 9, and 10 collectively represent a series of micrographs. They depict sections of the coupons, over the indicated time periods (0 min, 30 min, 60 min, and 120 min). With reference to FIG. 7, region 80 is the substrate, while region or sublayer 82 is the diffusion sublayer of the platinum aluminide diffusion coating. Sublayer 84 is the additive sublayer. The progressive micrographs show substantially-complete removal of the additive sublayer after about 60 minutes, with only minimal removal of the diffusion sublayer. After 120 minutes, a small portion of the diffusion sublayer was removed, and the substrate remained substantially intact, with only one relatively small pit. Thus, the present invention provides a substantial process "window" for removal of the diffusion sublayer. Such a window in turn provides flexibility and efficiency in a large-scale treatment facility. Subsequent experiments demonstrated even larger process windows for removal of the diffusion sublayer.

Clearly, many modifications and variations of the present invention are possible in light of the above teachings. It is therefore understood that, within the scope of the appended claims, this invention may be practiced otherwise than as specifically described.

What is claimed is:

1. An electrochemical process for selectively removing at least one coating from the surface of a substrate, comprising:

immersing the substrate in a composition through which electrical current flows at a potential of up to about 10 volts, wherein the composition comprises at least one halide salt, or precursor thereof wherein the substrate comprises a diffusion coating comprising a diffusion sublayer and an additive sublayer; and reacting the coating with the composition to remove the additive sublayer, wherein the diffusion sublayer is not substantially removed during removal of the additive sublayer.

2. The process of claim 1, wherein the salt is present at a level in the range of about 0.1 M to about 5 M.

3. The process of claim 2, wherein the salt is present at a level in the range of about 0.5 M to about 3.5 M.

4. The process of claim 1, wherein the halide salt is selected from the group consisting of sodium chloride, ammonium chloride, potassium chloride, sodium fluoride, ammonium bifluoride, and combinations thereof.

5. The process of claim 1, wherein the electrical current is direct current (DC).

6. The process of claim 1, wherein the composition is maintained at a temperature not greater than about 100° C.

7. The process of claim 6, wherein the composition is maintained at a temperature below about 50° C.

8. The process of claim 1, wherein the composition further comprises at least one additive selected from the group consisting of inhibitors, dispensersants, surfactants, wetting agents, stabilizers, and-settling agents, and pH buffers.

9. The process of claim 1, wherein the diffusion coating comprises an aluminide material.

10. The process of claim 9, wherein the aluminide material is selected from the group consisting of aluminide, noble metal-aluminide, noble metal-nickel-aluminide, and mixtures thereof.

11. The process of claim 1, wherein the substrate comprises a metallic material.

12. The process of claim 11, wherein the metallic material comprises at least one element selected from the group consisting of iron, cobalt, nickel, aluminum, chromium, titanium, and mixtures which include any of the foregoing.

13. The process of claim 12, wherein the metallic in material comprises a superalloy.

14. The process of claim 13, wherein the superalloy is nickel-based or cobalt-based.

15. The process of claim 14, wherein the superalloy is a component of a turbine engine.

16. The process of claim 1, wherein the substrate is immersed in the composition for a time period in the range of about 1 minute to about 36 hours.

17. The process of claim 16, wherein the time period of immersion is in the range of about 5 minutes to about 8 hours.

18. The process of claim 1, wherein the composition is stirred or agitated while the substrate is immersed therein.

19. The process of claim 1, further comprising the step of removing coating residue after immersion of the substrate in the composition.

20. The process of claim 19, wherein the coating residue is removed by at least one technique selected from the group consisting of abrasion, tumbling laser ablation, and ultrasonic agitation.

21. The process of claim 20, wherein the abrasion is carried out by a grit-blasting technique.

22. The process of claim 1, wherein the coating being removed is an additive sublayer of an aluminum-based diffusion coating.

23. The process of claim 1, wherein said potential is in the range from about 0.5 volts to about 5 volts.

24. An electrochemical process for selectively removing an additive sublayer of a diffusion platinum-aluminide coating from a superalloy substrate, comprising the step of immersing the substrate in a composition through which direct electrical current flows at a potential of up to about 10V;

wherein the composition comprises at least one halide salt, or precursor thereof, and wherein a diffusion sublayer between the additive sublayer and the substrate is not substantially affected while the additive sublayer is removed.

25. The process of claim 24, wherein the halide salt is sodium chloride.

26. The process of claim 24, wherein said potential is the range from about 0.5 volts to about 5 volts.

27. A method for replacing a worn or damaged diffusion aluminide coating applied over a substrate, comprising the following steps:

(i) electrochemically removing the worn or damaged coating by immersing the substrate in a composition through which direct electrical current flows at a potential of up to about 10 volts, wherein the composition comprises at least one halide salt or precursor thereof; and then (ii) applying a new coating over the substrate;

wherein the diffusion aluminide coating comprises a diffusion sublayer which lies over the substrate, and an additive sublayer which lies over the diffusion sublayer, and wherein the additive sublayer is removed, while the diffusion sublayer is substantially unaffected.

28. The method of claim 27, wherein the new coating is a diffusion-aluminide coating or an overlay coating.

29. The method of claim 28, wherein the overlay coating comprises a composition of the formula MCrAl(X), where M is an element selected from the group consisting of Ni, Co, Fe, and combinations thereof; and X is an element selected from the group consisting of Y, Ta, Si, Hf, Ti, Zr, B, C, and combinations thereof.

* * * * *